US008683721B1

(12) United States Patent
Bogdanski et al.

(10) Patent No.: US 8,683,721 B1
(45) Date of Patent: Apr. 1, 2014

(54) GREETING CARD WITH GAME

(71) Applicant: American Greetings Corporation, Cleveland, OH (US)

(72) Inventors: Sharon Bogdanski, San Diego, CA (US); Melissa Flesher, Avon, OH (US); Mike Gali, Cleveland, OH (US); Karen Rowlett, Avon Lake, OH (US); Annie Deckerd, Elyria, OH (US)

(73) Assignee: American Greetings Corporation, Cleveland, OH (US)

( * ) Notice: Subject to any disclaimer, the term of this patent is extended or adjusted under 35 U.S.C. 154(b) by 81 days.

(21) Appl. No.: 13/798,476

(22) Filed: Mar. 13, 2013

Related U.S. Application Data

(60) Provisional application No. 61/762,493, filed on Feb. 8, 2013.

(51) Int. Cl.
*A63F 7/36* (2006.01)
*G09F 1/00* (2006.01)

(52) U.S. Cl.
USPC ..... 40/124.02; 272/119 R

(58) Field of Classification Search
USPC ..... 40/124.01, 124.03, 124.06, 406, 409; 273/118 R, 119 R, 121 B; 446/147, 149, 446/76; D21/322, 323, 310, 311
See application file for complete search history.

(56) References Cited

U.S. PATENT DOCUMENTS

| | | | | | |
|---|---|---|---|---|---|
| 1,622,877 | A | * | 3/1927 | McMann | 273/119 R |
| 2,138,589 | A | * | 11/1938 | Wrigley | 206/457 |
| D170,908 | S | * | 11/1953 | Carver | D21/340 |
| D170,948 | S | * | 11/1953 | Schigas | D21/310 |
| D201,972 | S | * | 8/1965 | Johnson | D21/323 |
| 3,224,776 | A | * | 12/1965 | Mehelich | 273/121 R |
| D231,627 | S | * | 5/1974 | Cagan | D21/307 |
| D243,780 | S | * | 3/1977 | Yamagata | D21/323 |
| 4,273,341 | A | * | 6/1981 | Warrix | 273/357 |
| 4,361,327 | A | * | 11/1982 | Kurita et al. | 273/119 R |
| 6,279,904 | B1 | * | 8/2001 | Huang | 273/121 R |
| 7,195,241 | B1 | * | 3/2007 | Hartelius | 273/119 R |
| 7,264,155 | B2 | | 9/2007 | Halbur et al. | |
| 7,946,585 | B2 | | 5/2011 | Grist et al. | |
| 2009/0085286 | A1 | * | 4/2009 | Grist et al. | 273/121 D |

FOREIGN PATENT DOCUMENTS

GB 2144371 A * 3/1985

* cited by examiner

*Primary Examiner* — Casandra Davis
(74) *Attorney, Agent, or Firm* — Christine Flanagan

(57) ABSTRACT

The present disclosure and related inventions are directed to a greeting card or other social expression product which is combined with a simple game with sound and light effects. The greeting card combines a traditional paper greeting card, a plastic-molded game encasement and game board, lever, and game pieces with various electronic components to create an interactive greeting card with playable game that causes sound and light effects.

20 Claims, 2 Drawing Sheets

GREETING CARD WITH GAME

RELATED APPLICATIONS

This application claims priority to U.S. Provisional Patent Application No. 61/762,493, filed on Feb. 8, 2013, a copy of which is incorporated herein by reference in its entirety.

FIELD OF THE INVENTION

The present invention is in the field of social expression products, and more specifically directed to an interactive greeting card.

BACKGROUND OF THE INVENTION

For many years paper greeting cards containing text sentiment and associated artwork have been widely used for celebratory occasions such as birthdays, graduations, weddings, and for other commercial purposes. More recently, greeting cards have been enhanced by incorporating sound and other effects. Sound generating devices have been incorporated into traditional paper greeting cards to increase entertainment value and emotional impact. In some forms, a talking or musical greeting card looks just like a conventional greeting card, except that it includes a hidden sound module with a pre-recorded sound track. Opening the greeting card will automatically turn on or close a switch so that the sound module will play the pre-stored music or dialog and closing the greeting card will automatically open the switch and stop the play of the music or dialog.

There is a need in the art for a greeting card that increases the entertainment value and raises the surprise factor of traditional or sound generating greeting cards.

SUMMARY OF THE INVENTION

The present disclosure and related inventions are directed to a greeting card or other social expression product which is combined with a simple game with sound and light effects. The greeting card combines a traditional paper greeting card, a plastic-moulded game encasement and game board, lever, and game pieces with various electronic components to create an interactive greeting card with playable game that causes sound and light effects.

DETAILED DESCRIPTION OF PREFERRED AND ALTERNATE EMBODIMENTS

Figure 1:
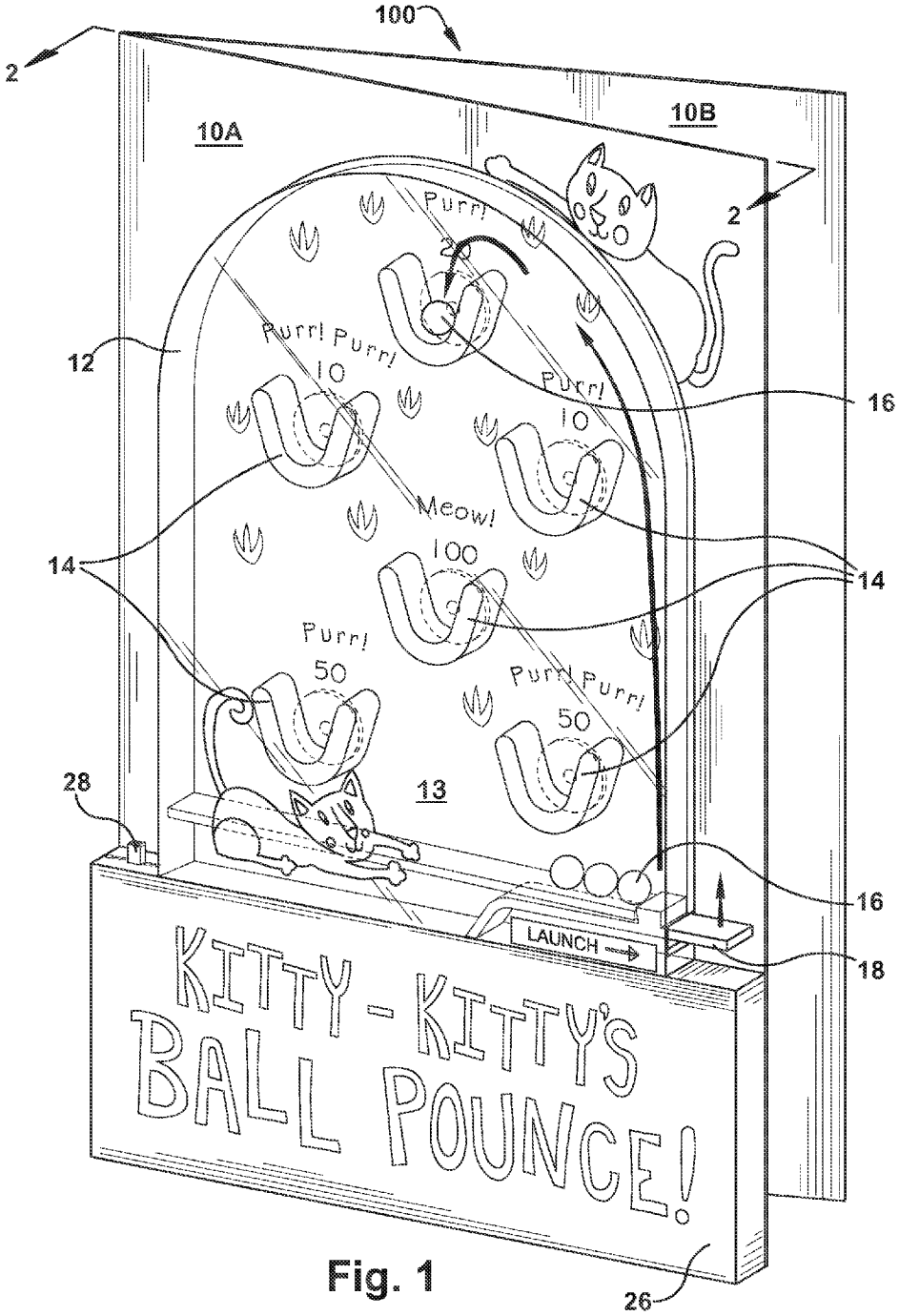
FIG. 1 is a perspective view of the greeting card of the present invention.
Figure 2:
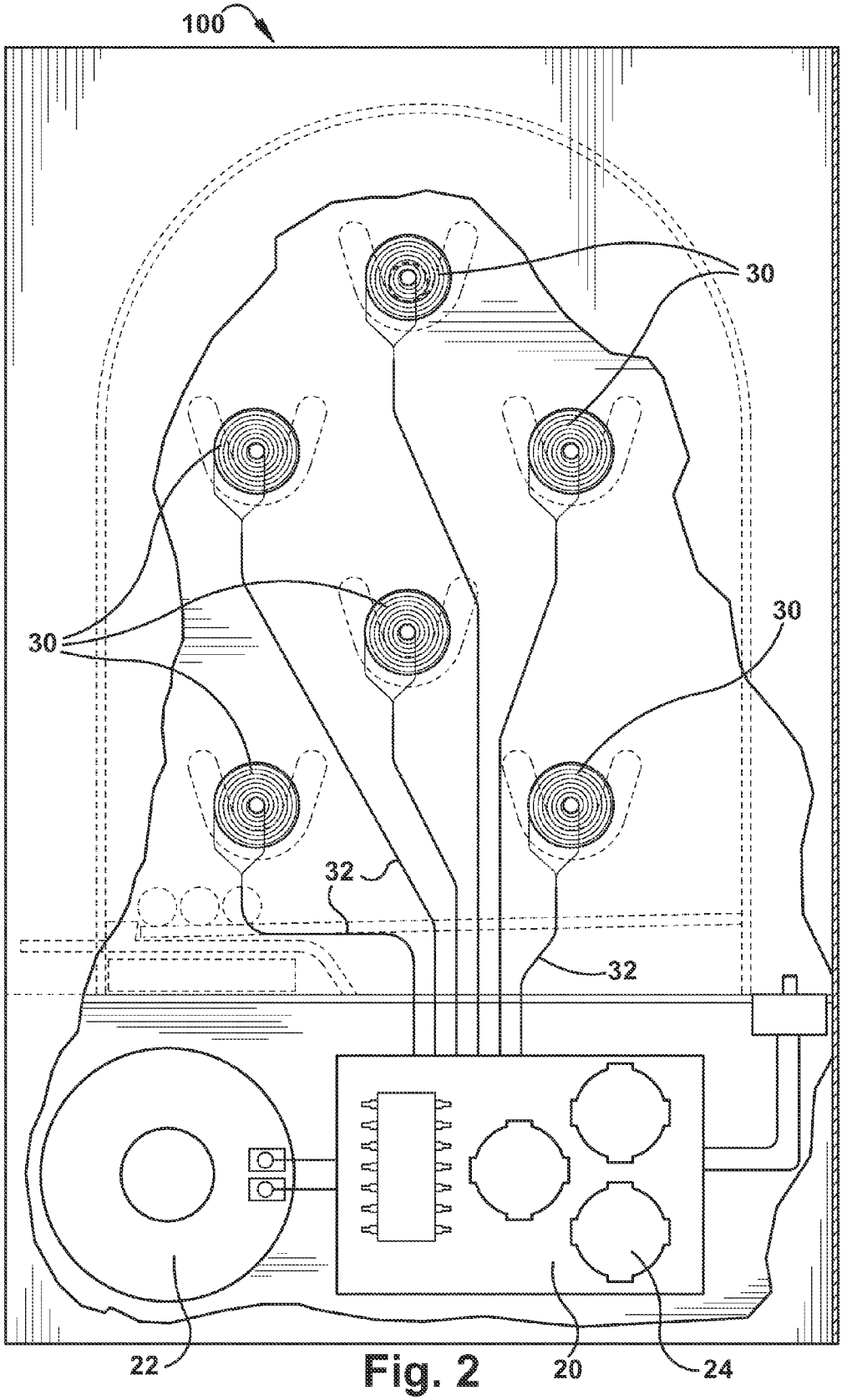
FIG. 2 is a rear tear-away view of the greeting card of FIG. 1 from the perspective of arrows 2-2.

The greeting card of the present invention combines a paper greeting card with a simple plastic-moulded game which interacts with the user via light and sound effects. The greeting card body 10 contains at least two greeting card panels, a front panel 10A and back panel 10B which are bisected by and connected along a center fold line. Both the front 10A and back 10B panels contain an inner surface and an outer surface opposite the inner surface. When the greeting card 100 is closed, the two panels 10A, 10B are in a stacked arrangement with the inner surface of the front panel facing and in direct contact with the inner surface of the back panel.

To open the greeting card 100, a user must pivot the front panel 10A along the center fold line away from the back panel 10B. The inner surface of the front 10A and back 10B panels may contain written sentiment, pictures, graphics, drawings or any other type of text, decoration or embellishment. The outer surface of the back panel 10B serves as the back cover of the greeting card 100 and the outer surface of the front panel 10A serves as the front cover of the greeting card 100 and as the backbone or substrate to which the game is attached.

In a preferred embodiment, the game is a mechanical ball launching or projection game wherein the object of the game is to launch or propel one or more balls into the prize or payoff area of the game board. The game body 12 is preferably a plastic-moulded enclosure having a substantially planar back panel which can be attached, adhesively or otherwise to the outer surface of the front greeting card panel 10A. In a preferred embodiment, the planar back panel of the game body 12 is plastic, but may be made of paper or other sufficiently rigid material having a front surface and a back surface opposite the front surface. The front surface of the game is preferably made of transparent moulded-plastic, having a transparent moulded-plastic perimeter extending between the front surface of the game and the substantially planar back panel of the game. One or more plastic u-shaped channels 14 are located within the enclosed game board 12 and extend between the front surface of the game and the substantially planar back panel of the game. The one or more u-shaped channels 14 serve as baskets or other open-topped cavity into which the one or more game balls 16 are aimed. The game body 12, as shown in the figures, is an arched shaped enclosure having a linear bottom edge. However, other shapes have been contemplated and are considered to be within the scope of the present invention. A ball projector handle or lever 18, preferably plastic, extends outward from the game body 12 proximate to the linear bottom edge. The handle 18 is configured to launch the one or more game balls 16 into the game board 12 and preferably into the u-shaped channels (hereinafter referred to herein as "baskets") 14. A printed insert 13 made of paper or paperboard (or other such material) may be placed on the inside surface of the substantially planar back panel of the game with printing thereon (which is visible through the front of the transparent plastic-moulded game body) which serves to inform the user where the prize or payoff areas of the game board are located. For example, a drawing of a basket and point values may be printed on the insert 13 between the front and back panels of the game beneath each of the one or more plastic-moulded baskets 14. Each of the baskets 14 may have a different point value printed above or proximate thereto. Other printing, such as game instructions, or other design effects may be contained on the front surface of the back of the game board as well. The baskets 14 and point values related thereto serve as the prize or payoff areas of the game. One or more small metal balls 16 are contained within the game body 12. The balls 16 may move freely throughout the game board. When the greeting card 100 is held by a user in an upright or vertical manner, the game balls 16 will be located along the bottom edge of the game board. With a single ball 16 atop the ball projector handle or lever 18, the handle or lever 18 may be compressed then released to launch or project the ball 16 into the game board 12, and preferably into one of the one or more baskets 14. If a ball 16 reaches the inside of the basket 14, audio and light effects are initiated as the game prize or payoff. Another game ball 16 may be launched into the game board 12. Each time a game ball 16 enters into one of the baskets 14, audio and light effects are initiated. A different audio clip may be replayed and a different lighting effect may be displayed depending on which basket 14 a game ball 16 enters. Game balls 16 may be removed from the baskets 14 by tilting the game (greeting card) 100 to the side or upside down, displacing the game balls 16 from the baskets 14 to the bottom of the game board 12, ready to be re-launched into the game board 12.

The audio and lighting effects are enabled by various electronic and electro-mechanic components contained within the greeting card 100. These components may include, but are not limited to: a circuit board 20, an integrated circuit, a speaker 22, a power source such as one or more batteries 24, a memory device containing one or more pre-recorded audio files or clips, one or more switches or trigger mechanisms, one or more LED lights, and any other electronic and/or electro-mechanic components which are required or which facilitate or enhance the audio playback and light effects which are known to those with skill in the art. The electronic and/or electro-mechanical components may be contained in a foam (or other material) encasement wrapped in paperboard (or other material) and attached to the front cover 10A of the greeting card 100, beneath the game 12. The paperboard covering may be printed or decorated with text sentiment, drawings, pictures, photos, or other printing or embellishments contained thereon. The paperboard-covered foam encasement 26 and electronics may have the same or substantially similar thickness as the plastic-moulded game board 12. In a preferred embodiment, the greeting card 100 contains an on/off switch 28 which controls power to the greeting card 100 for the audio and lighting effects. When the switch 28 is in the on position, the audio and light effects are enabled and when the switch 28 is in the off position, the audio and light effects are disabled. The on/off switch 28 may be accessible through an opening in the paperboard-covered foam encasement 26 which houses the electronic components, as shown in FIG. 1. Turning the on/off switch 28 from the off position to the on position may cause playback of an initial audio clip and also cause an LED light bulb to flash. One or more leaf switches 30 may be contained beneath the substantially planar back panel of the game, beneath the baskets 14 or payoff areas of the game board. The leaf switches 30 are connected to the circuit board 20 via wires 32 that extend from each leaf switch 30 to the circuit board 20, which is contained in the paperboard-covered foam encasement 26. When a game ball 16 enters one of the baskets 14, it places pressure on the leaf switch 30, causing the circuit to close and initiating audio playback and light effects. One leaf switch 30 is contained behind each basket 14 in the game board 12. As mentioned above, each leaf switch 30/basket 14 combination may cause playback of a different audio clip, in some cases, making reference to the point value of the particular basket 14. Each leaf switch 30/basket 14 combination may also cause different lighting effects. Another leaf switch 30 is contained behind the plastic ball projector handle or lever 18 which senses when the handle or lever 18 is being used. In order to save the battery life, the electronics will automatically turn off 30 seconds after the last time the handle or lever 18 was used.

While a particular card construction, game type, game board shape, game board location within the greeting card, switch types or trigger mechanism, and the location of electronic components have been particularly described herein and shown in the figures, other variations on these features have been contemplated and are considered to be within the scope of the present invention. It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:

a greeting card body having a front panel attached to a back panel along a fold line, the front and back panels each having an outer surface and an inner surface opposite the outer surface;

an interactive game attached to the greeting card body, the interactive game comprising: a transparent sealed game body having a front surface and a back surface and a perimeter surface therebetween; one or more u-shaped channels contained between the front and back surface; a lever; and one or more game balls;

a sound module operative to store and replay at least one audio file;

a light module operative to illuminate one or more LED lights;

an on/off switch;

at least one additional switch which causes playback of at least one audio file upon the one or more game balls entering the one or more u-shaped channels.

2. The greeting card of claim 1, wherein an audio file is replayed upon turning the on/off switch from the off position to the on position.

3. The greeting card of claim 1, wherein the at least one additional switch is a leaf switch.

4. The greeting card of claim 1, wherein the lever is used to launch the one or more game balls into the one or more u-shaped channels.

5. The greeting card of claim 1, wherein the transparent sealed game body is attached to the outer surface of the front panel of the greeting card body.

6. The greeting card of claim 1, wherein the transparent sealed game body is plastic.

7. The greeting card of claim 1, wherein the interactive game automatically shuts off after the lever has not been used for a pre-determined period of time.

8. A greeting card comprising:

a two panel greeting card body;

a plastic moulded game attached to a front surface of the two panel greeting card body;

the plastic moulded game having an enclosed cavity, a plurality of open-topped channels contained within the enclosed cavity, a ball launch mechanism, and two or more balls;

a sound module operative to store and playback a plurality of audio files;

a light module operative to illuminate one or more LED lights;

an on/off switch which provides power to the sound and light modules;

a plurality of switches contained and concealed behind each of the plurality of open-topped channels contained within the enclosed cavity such that when the on/off switch is in the on position and one of the two or more balls land in one of the plurality of open-topped channels, one of the plurality of audio files is replayed and at least one of the one or more LED lights flash.

9. The greeting card of claim 8 further comprising an additional switch located and concealed beneath the ball launch mechanism.

10. The greeting card of claim 9, wherein when the ball launch mechanism has been unused for a pre-determined period of time, power to the greeting card is turned off.

11. The greeting card of claim 8, wherein the plurality of switches is leaf switches.

12. The greeting card of claim 8, wherein a different one of the plurality of audio files is replayed depending on which of the plurality of open-topped channels one of the two or more game balls lands in.

13. The greeting card of claim 8, wherein one of the plurality of audio files is replayed upon turning the on/off switch into the on position.

14. The greeting card of claim 8 further comprising a printed insert which is located within the enclosed cavity of the plastic moulded game behind the plurality of open-topped channels.

15. The greeting card of claim 14, wherein the printed insert contains point values associated with each open-topped channel printed thereon beneath each open-topped channel.

16. A greeting card comprising:

a game comprising a transparent enclosed cavity having two or more baskets contained therein, two or more game balls contained therein and a lever for projecting the two or more game balls into the two or more baskets;

a sound module operative to store and playback two or more audio files;

wherein when one of the two or more game balls lands in one of the two or more baskets, the sound module initiates playback of one of the two or more audio files.

17. The greeting card of claim 16 further comprising a light module operative to illuminate one or more LED lights when one of the two or more game balls lands in one of the two or more baskets.

18. The greeting card of claim 16 further comprising an on/off switch.

19. The greeting card of claim 16 wherein power to the sound module is turned off when the lever goes unused for a pre-determined amount of time.

20. The greeting card of claim 16, wherein the game is attached to one of two attached greeting card panels.

* * * * *